US007753195B2

(12) United States Patent
Cuomo

(10) Patent No.: US 7,753,195 B2
(45) Date of Patent: Jul. 13, 2010

(54) CARRIER AND METHOD

(75) Inventor: Angelo V. Cuomo, Staten Island, NY (US)

(73) Assignee: SJV Food & Beverage Carriers, Inc., Clark, NJ (US)

( * ) Notice: Subject to any disclaimer, the term of this patent is extended or adjusted under 35 U.S.C. 154(b) by 1135 days.

(21) Appl. No.: 11/345,898

(22) Filed: Feb. 2, 2006

(65) Prior Publication Data

US 2006/0148629 A1 Jul. 6, 2006

Related U.S. Application Data

(63) Continuation-in-part of application No. 11/301,407, filed on Dec. 13, 2005, now Pat. No. 7,438,181, and a continuation-in-part of application No. 11/301,913, filed on Dec. 13, 2005, now Pat. No. 7,475,772, and a continuation-in-part of application No. 11/012,789, filed on Dec. 15, 2004, now Pat. No. 7,370,755, and a continuation-in-part of application No. 11/012,440, filed on Dec. 15, 2004, now Pat. No. 7,383,949, and a continuation-in-part of application No. 10/939,264, filed on Sep. 10, 2004, now Pat. No. 7,604,115, and a continuation-in-part of application No. 10/737,612, filed on Dec. 16, 2003, now Pat. No. 7,267,224, and a continuation-in-part of application No. 10/662,265, filed on Sep. 15, 2003, now Pat. No. 7,243,785, and a continuation-in-part of application No. 10/215,938, filed on Aug. 9, 2002, now Pat. No. 7,185,758.

(51) Int. Cl.
*B65D 75/00* (2006.01)

(52) U.S. Cl. ..... 206/176; 206/162; 206/170; 206/175; 206/193; 229/117.01; 229/120.38

(58) Field of Classification Search ..... 206/162, 206/170, 172, 174, 175, 180, 187, 188, 197, 206/549, 427, 176; 229/120.38, 120.36, 229/120.27, 117.09, 934, 937, 117.01
See application file for complete search history.

(56) References Cited

U.S. PATENT DOCUMENTS

| | | | | |
|---|---|---|---|---|
| 2,011,232 | A * | 8/1935 | Parks et al. | 229/117 |
| 2,026,525 | A | 1/1936 | Korte | |
| 2,405,517 | A | 8/1946 | Plummer | |
| 2,513,079 | A * | 6/1950 | Buerger | 229/117 |
| 2,543,821 | A * | 3/1951 | Arneson | 206/180 |
| 2,594,376 | A | 4/1952 | Arneson | |
| 2,630,264 | A | 4/1953 | Holy | |
| 2,665,049 | A * | 1/1954 | George | 206/200 |
| 2,742,182 | A * | 4/1956 | Hickin et al. | 206/200 |
| 3,158,286 | A | 11/1964 | Phillips, Jr. | |

(Continued)

*Primary Examiner*—David T Fidei
(74) *Attorney, Agent, or Firm*—Gregor N. Neff

(57) ABSTRACT

A foldable carrier is provided with a vertical support panel structure made as a first component, and an external side wall structure as a second component. The vertical support panel structure and the external side wall structure are joined together to form two separate receptacles extending from opposite sides of said vertical panel structure to hold objects to be carried in the carrier. Preferably, the vertical support panel structure is made of an untreated and relatively inexpensive material, and the external side wall structure is made of a material treated to give it good resistance to weakening when wet.

10 Claims, 6 Drawing Sheets

U.S. PATENT DOCUMENTS 3,266,663 A * 8/1966 Ringler ..... 206/178
3,278,076 A 10/1966 Graser
3,712,505 A 1/1973 Stevin
3,780,906 A 12/1973 Katzenmeyer
3,927,824 A * 12/1975 Razziano ..... 229/117
4,378,880 A 4/1983 Summers
4,469,222 A 9/1984 Graser
4,610,349 A 9/1986 Schwartz et al.
4,767,051 A 8/1988 Single
4,770,294 A 9/1988 Graser
4,836,367 A 6/1989 Golkar
5,052,552 A 10/1991 Maroszek
5,275,331 A * 1/1994 Chung-Piao ..... 229/117.15
5,680,930 A 10/1997 Stone
5,695,051 A 12/1997 Hart
5,709,298 A 1/1998 Harris
5,913,473 A * 6/1999 Wang ..... 229/120.07
5,927,502 A 7/1999 Hunter
5,927,593 A * 7/1999 Berkowitz et al. ..... 229/117
5,947,273 A 9/1999 Dalrymple et al.
6,131,729 A 10/2000 Eckermann et al.
6,341,689 B1 1/2002 Jones
6,443,308 B1 9/2002 Davis
7,128,206 B2 * 10/2006 Kohler ..... 206/176

* cited by examiner

CARRIER AND METHOD

This patent application is a continuation-in-part of U.S. patent application Ser. No. 10/215,938 filed Aug. 9, 2002 now U.S. Pat. No. 7,185,758; Ser. No. 10/662,265, filed Sep. 15, 2003 now U.S. Pat. No. 7,243,785; Ser. No. 10/737,612 filed on Dec. 16, 2003 now U.S. Pat. No. 7,267,224; Ser. No. 10/939,264 filed on Sep. 10, 2004 now U.S. Pat. No. 7,604,115, Ser. No. 11/012,440 filed on Dec. 15, 2004 now U.S. Pat No. 7,383,949, Ser. No. 11/012,789, filed Dec. 15, 2004 now U.S. Pat. No. 7,370,755, Ser. No. 11/301,913, filed Dec. 13, 2005 now U.S. Pat. No. 7,475,722, and Ser. No. 11/301,407, filed Dec. 13, 2005 now U.S. Pat. No. 7,438,181. The disclosure of those patent applications are hereby incorporated herein by reference.

This invention relates to carriers for beverages, food, liquids in containers and other objects, and to methods of making and using such carriers.

In the above-identified prior patent applications are disclosed a number of different general-purpose carriers, and other carriers which are highly advantageous for use in carrying beverages, e.g., in "six packs" of bottles containing soft drinks, beer, etc. Other carriers are specially adapted for use in carrying both beverage cups and solid foods in or from sports arenas, fast-food restaurants, etc.

It is an object of the invention to reduce the cost of manufacturing such carriers by reducing the materials cost and/or by increasing the production rate of the carriers.

Carriers for carrying liquids usually need to have good wet-strength; that is, good strength even when fully or partially soaked with water or other liquids. Thus, such carriers often are made of treated fiberboard materials such as "SUS" plastic-treated fiberboard which retain a good portion of their original strength when wet.

Such treated materials are relatively expensive. One way that this expense has been offset, in part, in the past, is by making some parts of the carriers out of untreated, less expensive materials. However, the resulting carrier is not as strong or inexpensive or easy to use as it could be.

Accordingly, it is an object of the invention to provide a carrier having the highly advantageous features described in the above-identified patent applications in which the manufacturing costs are significantly reduced without unduly compromising the strength and durability of the carrier, even when wet.

In accordance with the present invention, the foregoing objects are satisfied by providing a carrier with a vertical support panel structure and two foldable receptacles, each extending outwardly from the lower regions of the vertical support panel structure. A bottom structure unfolds automatically as the carrier blank is unfolded in order to erect the carrier.

The cost of making the carrier is reduced by using a combination of relatively high wet-strength, relatively expensive materials for part of the carrier, and relatively less expensive material for the rest.

Selecting the components which can be made of the less expensive materials without unduly weakening the carrier and without overly complicating the manufacturing process and machinery is a difficult problem.

In accordance with the invention, the external wall structure of the carrier is made of the treated material and the vertical support panel structure is made of the less expensive material. Preferably, the bottom-forming flanges extending downwardly from the lower edges of the external walls and the vertical support panels are integral with and made of the same material as the panels from which they extend.

Preferably, the vertical support panels form a handle structure which is used to lift and carry the carrier and its load. Preferably, it is covered with a layer of the high-wet-strength material.

The invention makes it possible to reduce the cost of the carrier while giving the carrier maximum wet strength and durability by using high wet-strength materials throughout, but making the carrier from two separate blanks rather than one and folding and gluing the two blanks in separate processes simultaneously, and then joining the blanks together to finish the folded carrier. This speeds the manufacturing process and, therefore reduces manufacturing cost without sacrificing wet strength and durability.

It also is an object of the invention to provide a carrier with all of the advantages discussed above, but which can be made by the use of machinery which already is used to make prior carriers, thus minimizing the cost for added manufacturing equipment.

The manufacturing process is relatively simple, even though two separate parts of the carrier are made separately and then secured together. The reduction in material cost and/or manufacturing time reduces overall manufacturing costs significantly, without significantly reducing the strength or durability of the carrier.

In the version of the carrier which can be used conveniently at fast-food outlets to carry both beverages and solid foods in an auxiliary tray mounted on the carrier handle, the tray can be made of the less expensive, less liquid-resistant material, because it usually is used to carry dry objects.

As with some of the carriers shown in the above-identified patent applications, the vertical support panel structure can be made either with two panels fastened together back-to-back, or with the two panels hinged together so that advertising and/or promotional materials can be located on the inside surfaces of the panels, and the panels can be swung apart to give access to the customer.

The foregoing and other objects and advantages of the invention will be apparent from or set forth in the following description and drawings.

IN THE DRAWINGS

SIX-PACK CARRIER—GENERAL CONSTRUCTION

Figure 1:
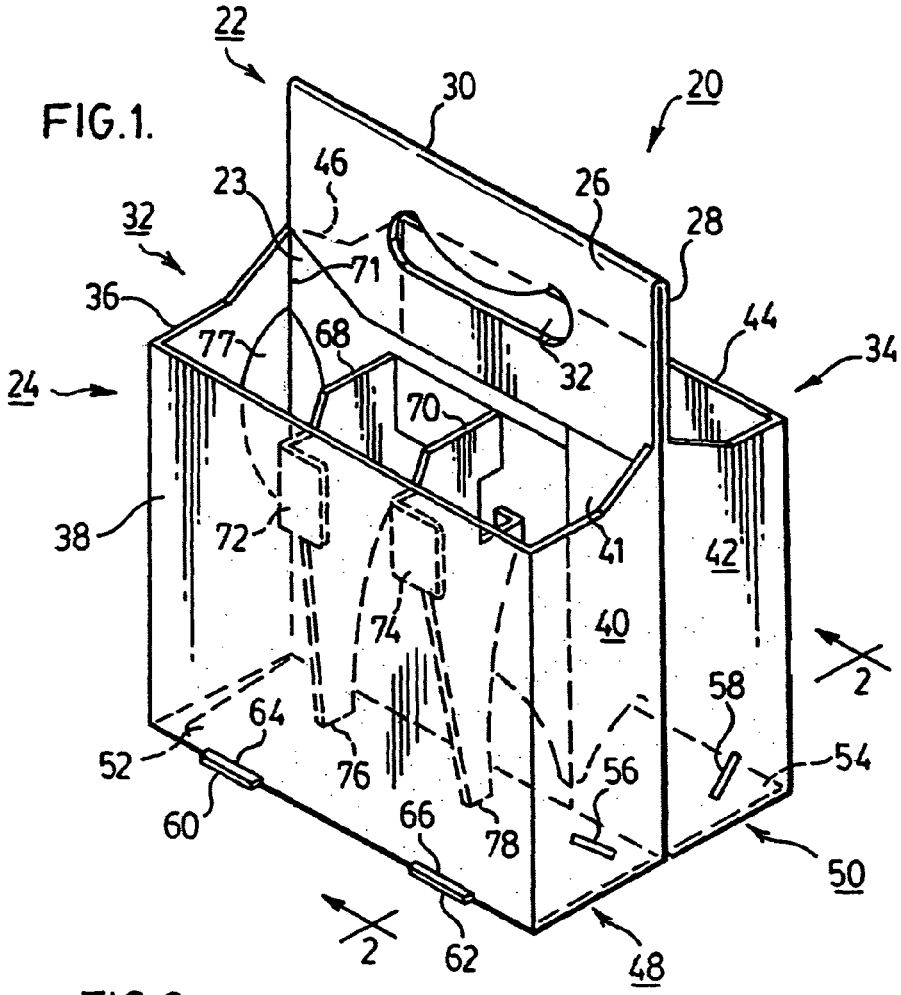
FIG. 1 is a perspective view, partially broken-away, of one embodiment of a carrier constructed in accordance with the present invention.

FIG. 1 is a perspective view of a six-pack carrier 20 constructed in accordance with the present invention.

The carrier 20 is very similar to the six-pack carriers described in some of the above-identified pending patent applications. It includes a central vertical support panel structure 22 and an external side-wall structure 24 assembled together to form two receptacles 32 and 34, one extending outwardly from each side of the structure 22.

In accordance with the present invention, the applicant has determined that the vertical support panel structure 22 can be made as a component separately from the remainder of the carrier and thereby increase production rates for the carrier.

Also, the vertical support panel structure 22 can be made of relatively inexpensive, untreated fiberboard, whereas the external wall structure 24 preferably is made of treated fiberboard material which has been made resistant to weakening when wet. This also reduces the cost of the carrier without unduly weakening it. This is achieved despite the fact that the vertical support panel structure is used to lift the carrier and to hold the receptacles together.

The applicant also has found that at least one component of the bottom structure 48 or 50 of each receptacle can be made of the same untreated fiberboard material as the vertical support panel structure 22 without unduly weakening the carrier.

The external side wall structure 24 forming the receptacle 32 comprises a short end wall 36 joined along a fold line to a long side wall 38, with a short side wall 40 secured to the long side wall 38 along a fold line at the opposite end of the long side wall.

Similarly, the external side wall structure 24 forming the receptacle 34 includes a short side wall 46 joined along a fold line to a long side wall 44 which, in turn, is joined along a fold line with a short end side wall 42.

Carrier Blanks

Figure 3:
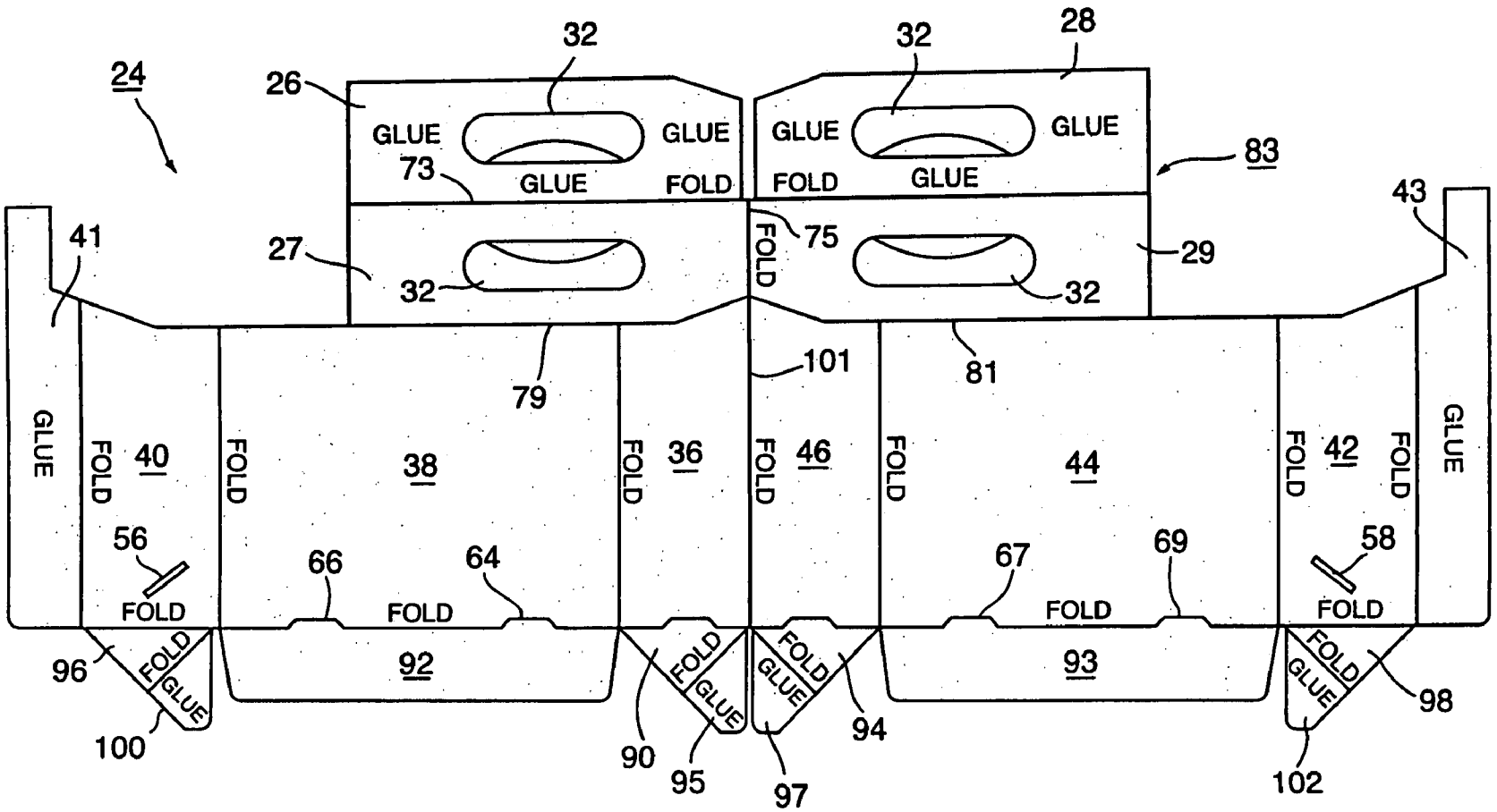
FIGS. 3 and 4 are plan views of blanks used for forming the carrier of FIG. 1

FIG. 3 shows the blank used to form the external side wall structure 24. In FIG. 3, lines along which folds are made are marked "FOLD", and the other lines shown are lines along which the fiberboard material of the blank is cut, with the exceptions noted below. Areas to be glued are marked "GLUE".

As it can be seen in FIG. 3, there is a relatively wide flap or flange 41 extending from the left edge of the panel 40, and a mirror-image flap or flange 43 extending from the right side edge of panel 42.

Figure 4:
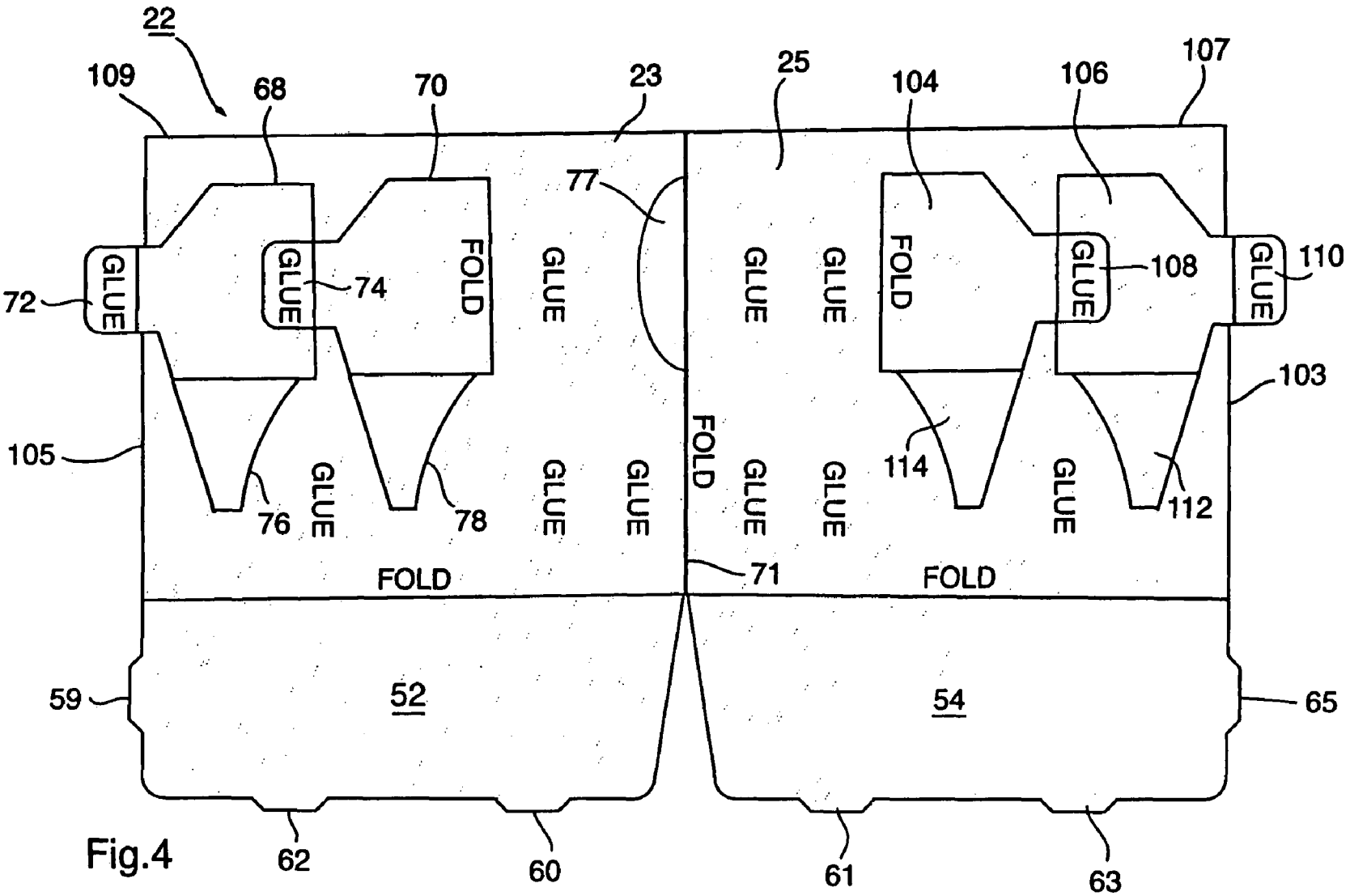

The blank for the vertical support panel structure 22 is shown in FIG. 4. This structure 22 includes a pair of vertical support panels 23 and 25 which are joined together at their side edges along a fold line 71 (also see FIG. 2) and are folded along that line to form the vertical support panel structure 22. A flap 77 is cut in the panel 23 and is used to fasten the vertical support panel structure 22 to the end wall 36 (see FIG. 1).

Dividers

Each of the panels 23 and 25 has a pair of fold-out die-cut panels 68 and 70 or 104 and 106 which are used to form dividers for the receptacles. The dividers 68 and 70 have folded-over tabs 72 and 74 at one end which are glued to the inner surface of the long side wall 38 to thereby divide the receptacle 32 into three compartments for objects to be carried, such as beverage bottles or cans.

Referring again to FIG. 4, each of the divider panels 104 and 106 has a tab 108 or 110 which is secured to the inside surface of the long side wall 44, thus dividing the receptacle 34 into three beverage-receiving compartments.

The lower ends 76 and 78 of the divider panels 68 and 70 are relatively long, narrow and flexible so that they provide cushioning between adjacent glass bottles in the compartments of the receptacle, and yet bend temporarily out of the way when the panels 52 and 54 are swinging downwardly from the initial vertical position to the horizontal position.

Assembly

Referring again to FIG. 1, when the carrier 20 is finally assembled into a folded carrier, the left edge 105 and the right edge 103 of the blank shown in FIG. 4 are folded over onto one another and inserted between folded-over opposing flanges 41 and 43 (FIG. 3) and glued together. This, as well as the flange 77, securely fasten the external side wall structure 24 to the vertical support panel structure 22.

Handle Structure

FIG. 3 also discloses a handle structure 83 which includes four panels 26 and 28 and 27 and 29, each of which has a hand hole 32. The handle structure 83 is secured to the top edge of the side wall blank along weak perforation lines 79, 81 which are designed to break easily as the carrier is being unfolded, as it is well known in the art.

The panels 26 and 28 are folded downwardly along a fold line 73 and glued onto the panels 27 and 29, respectively, and then the construction is folded along the vertical center fold line 75 and glued over the top edges 107 and 109 (FIG. 4) of the vertical support panel structure 22, when the carrier is being folded and glued. In this manner, a four-ply handle made out of treated fiberboard covers the untreated fiberboard and strengthens the handle and vertical support structure.

Bottom Structure

Referring again to FIG. 1, each of the receptacles 32 and 34 has a bottom structure 48 or 50. (Also see FIG. 2.)

Figure 2:
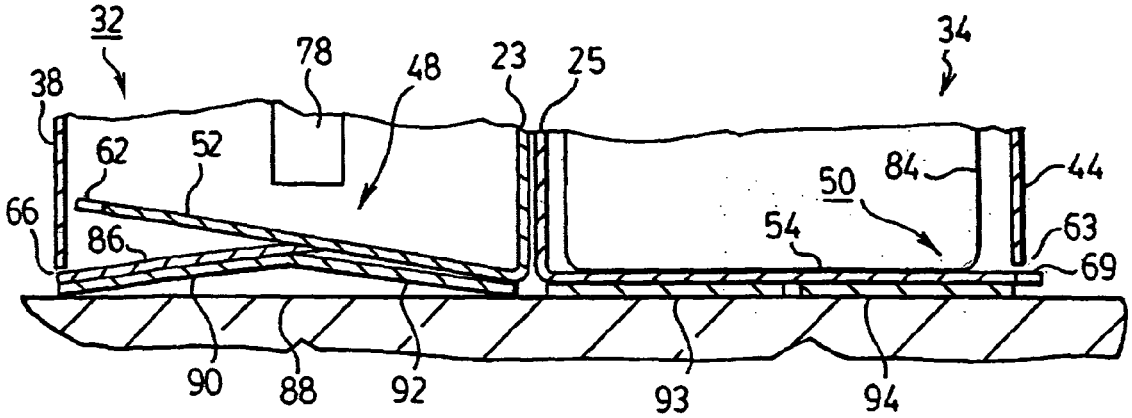
FIG. 2 is a cross-sectional view taken along line 2-2 of FIG. 1.

As it is shown in FIGS. 2, 3 and 4, the bottom structure is made of a plurality of flanges which extend from the lower edges of the vertical support panels 23 and 25 and the side walls of the external side wall structure 24.

Referring to FIG. 3, each of the shorter side walls 36, 40, 42 and 46 has a triangular flange consisting of an inner and an outer part 96, 100 or 90, 95 or 94, 97 or 98, 102. The inner and outer parts are joined along a fold line, and the outer part is a glue tab.

The long side walls 38 and 44 have flanges 92 and 93 extending from their lower edge.

Referring now to FIG. 4, the lower edges of the panels 23 and 25 have relatively wide panels 52 and 54 extending from their lower edges along a fold line. Each of these panels is wider than either of the panels 92 and 93 and spans the entire width of the receptacle 32 or 34 in which it is located.

As it is described more fully in the above-identified pending patent applications, the tabs 100, 95, 97 and 102 are glued to one of the flanges adjacent to it to form a bottom structure which automatically unfolds to a horizontal orientation as shown in FIG. 1 when the carrier is unfolded.

FIG. 2 shows the wide panel 52 in the receptacle 32 in a position intermediate its vertical, fully folded position and its horizontal, fully unfolded position. When it is in this position, it helps to hold each receptacle 32 or 34 open until it is loaded with beverage containers.

As with the carriers shown in the above-identified patent applications, it should be understood that, as an alternative, the wide flanges can be located along the bottom edges of the long side walls 38 and 44 instead of the bottom edges of the vertical support panels.

The receptacle 34 is shown in FIG. 2 with a beverage container 84 positioned in the receptacle, and with the bottom wall structure fully unfolded.

Lock Open Feature

As it can be seen in FIGS. 3 and 4, as well as in FIGS. 1 and 2, each of the wide flanges 52 and 54 has a pair of tabs 60, 62 or 61, 63 extending from its lowermost edge. These tabs fit into slots 66, 64 or 67, 69 (FIG. 3) to hold the flanges 52 and 54 down in the horizontal position.

Each of the wide flanges 52 and 54 has another tab 59 or 65 extending from one side edge of the flange. This tab is positioned to fit into a slot 56 or 58 in the external side wall 40 or 42 while the flange 52 or 54 is swinging downwardly from its upward folded position to its fully unfolded position. The natural tendency of the unfolded carrier is to fold up again, which urges side walls 40 and 42 towards the tabs 59 or 65.

This arrangement acts as a detent to help hold the receptacles 32 and 34 open until beverages are placed in them, thus facilitating loading of the bottles by machines in a bottling plant, or by hand. This feature is described in greater detail in my above-identified pending U.S. patent application Ser. No. 11/301,307 filed Dec. 13, 2005.

Manufacturing Method

Figure 5:
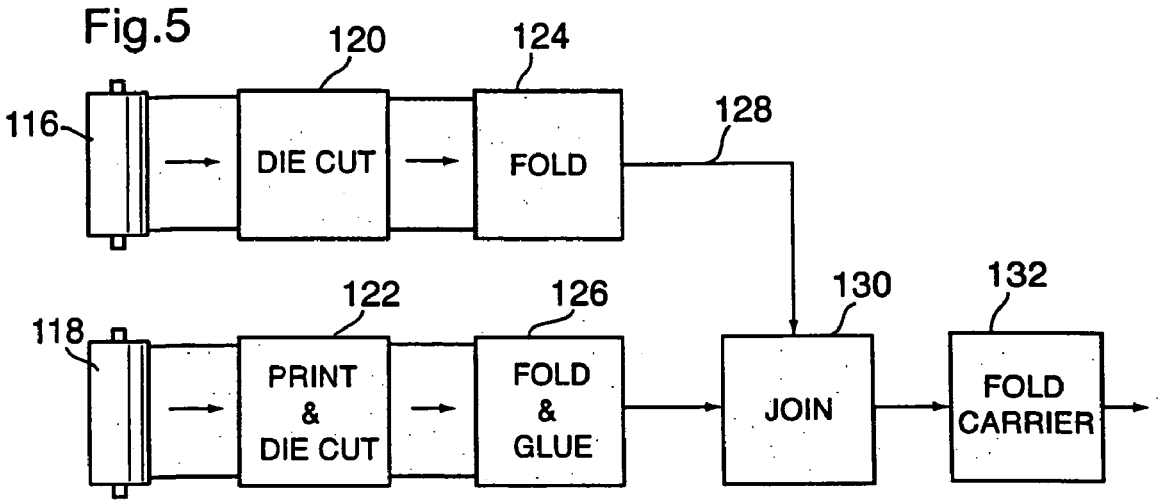
FIG. 5 is a schematic view illustrating the method which is used to make the carriers of the invention.

FIG. 5 is a schematic diagram illustrating the method of manufacturing the carrier 20. Two separate sources 116 and 118 of fiberboard sheet material are provided. In one embodiment, the source 116 is a roll of untreated fiberboard, and the source 118 is a roll of treated fiberboard. In another embodiment, the material in both rolls can be the same, both being untreated or treated material. The sheet material is supplied from rolls, but it also can be supplied in the form of cut sheets.

The sheet material travels from the source 116 to die-cutting equipment 120. The blanks shown in FIGS. 3 and 4 are cut out from the sheet material in a nested pattern which maximizes usage of the material. The blanks then are conveyed to folding equipment 124, where by are folded.

The other sheet material moves from the source 118 to printing and die-cutting equipment 122, which prints and die-cuts the external side wall blanks, and the blanks then are conveyed to folding and gluing equipment 126.

The vertical support panel blanks are then transported along a path indicated by the arrow 128 in FIG. 5 to joining equipment 130 where the support panel blanks are overlaid onto the external side wall blank shown in FIG. 3, with the center fold lines 71 and 101 and the bottom edges of the panels aligned with one another, and pressed together to securely fasten the glued areas to the desired panel portions.

Then, both blanks are folded along the fold lines 71 and 101 and other gluing and folding is done at a station 132 to form the finished carrier.

It is preferred that the separate carrier components in the two processing lines move in synchronism with one another. That is, a particular vertical support structure cut from one sheet preferably moves in synchronism with a specific external side wall structure cut from the other sheet so that when they finally meet to be joined, they will arrive at the joining equipment simultaneously. This synchronism is maintained by use of known computer-controlled equipment which now is in use in making prior dual-component carriers.

The folded carriers then can be boxed and shipped to remote bottling plants where they are removed from the boxes, pressed along the side edges to open them, and filled with beverages before being shipped to stores or other distribution points.

Alternative Embodiment

Figure 6:
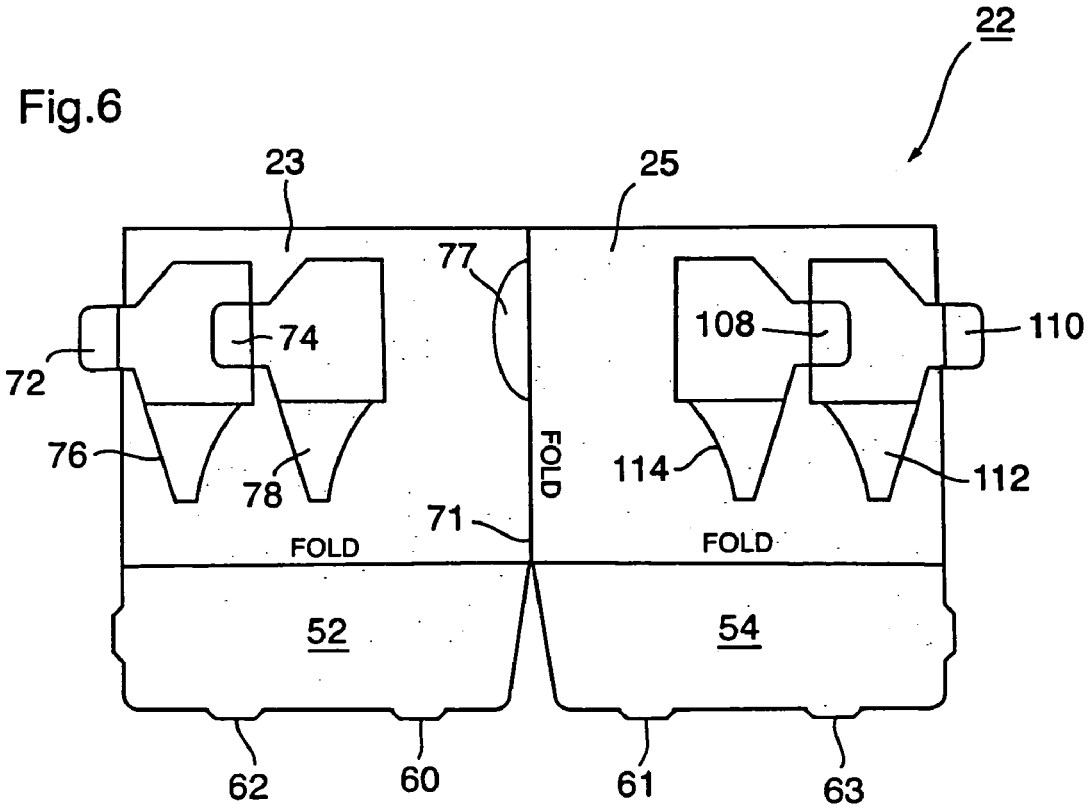
FIGS. 6 and 7 are plan views of blanks for forming another embodiment of the carrier of the invention.
Figure 7:
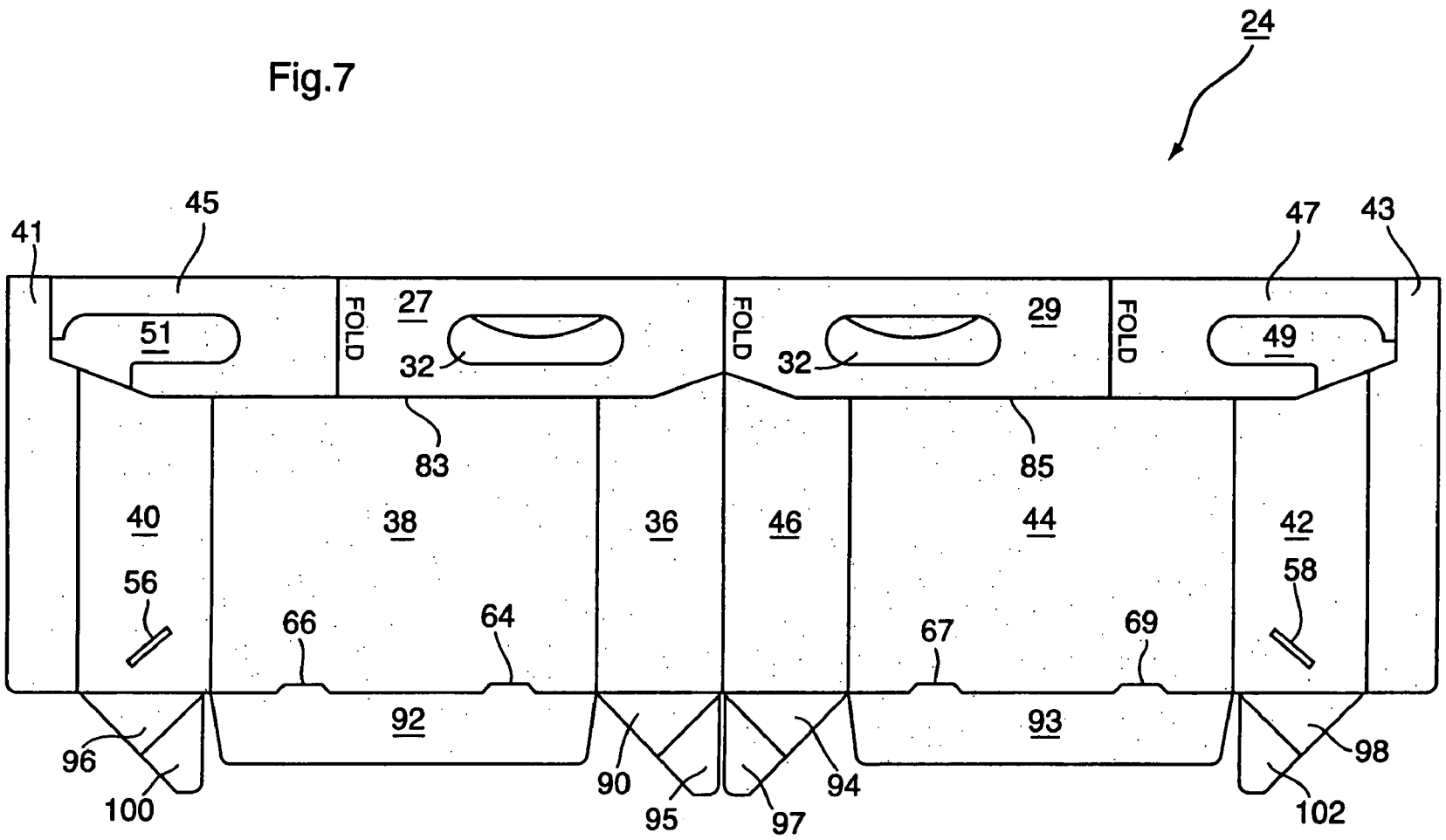

FIGS. 6 and 7 show, blanks for another bi-material carrier which is the same as that shown in FIGS. 1-4 except for the handle structure.

The handle structure of the carrier shown in FIGS. 6 and 7 differs from that shown in FIGS. 1-4 in that instead of having handle panels foldable upon one another along horizontal fold lines, additional handle panels 45 and 47 with hand holes 51 and 49, respectively, are secured to the handle panels 27 and 29 along vertical fold lines to form a four-ply handle structure. Weak perforations 83 and 85 join the handle structure to the side wall blank upper edge.

This arrangement is advantageous, in some manufacturing circumstances, in that the blank 24 in FIG. 7 is not as tall as that shown in FIG. 3. This can provide improved nesting of the blanks on a sheet and improved utilization of the sheet material. Weak perforations 83 and 85 join the handle structure to the side-wall blank upper edge.

"Saddle Bag" Embodiment

Figure 8:
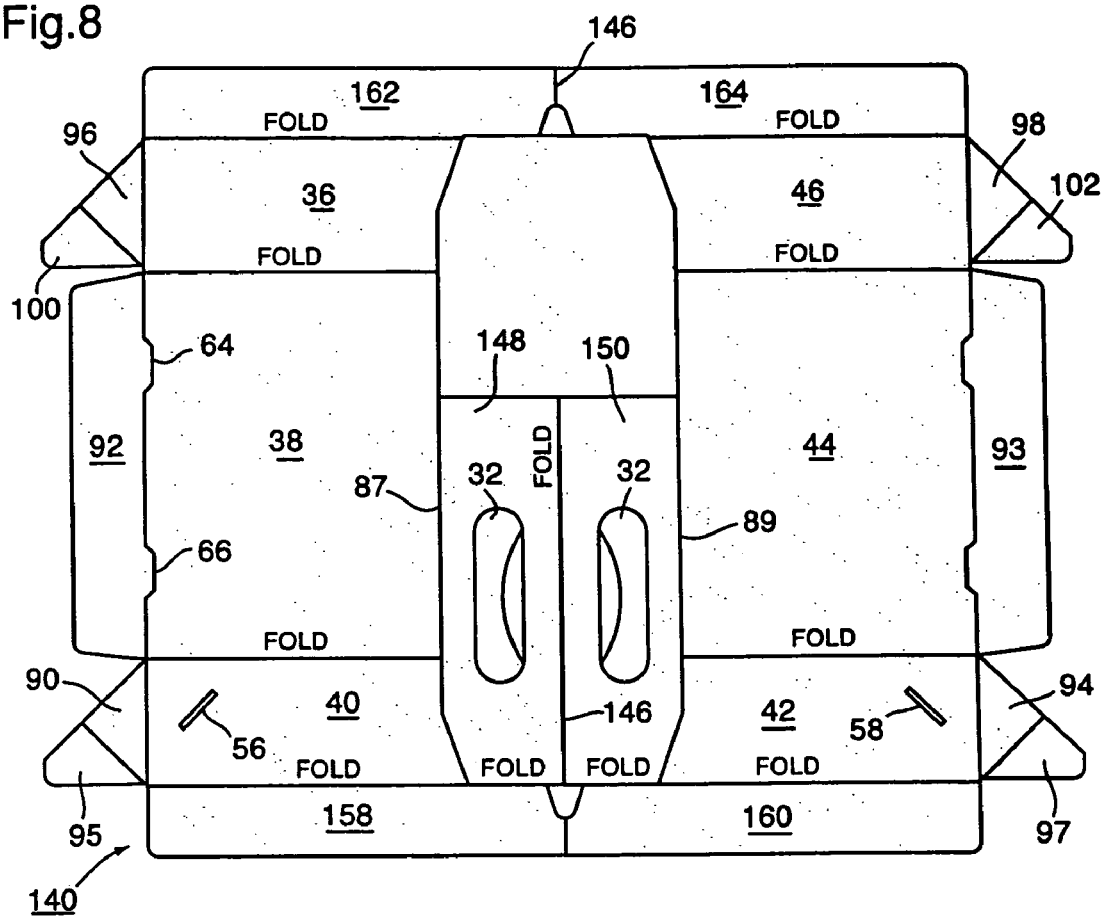
FIGS. 8 and 9 are plan views of blanks used to make another embodiment of the carrier of the invention.
Figure 9:
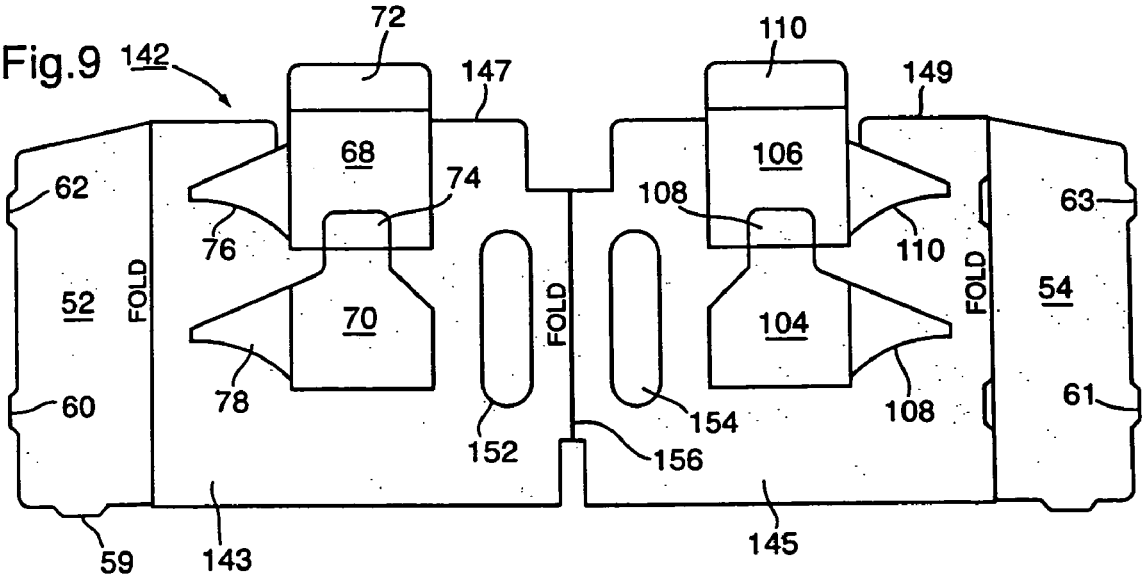

FIGS. 8 and 9 show the blanks for the external wall structure 140 and the vertical support panel structure 142 of what is called the "saddle bag" embodiment of the carrier.

As with the other embodiments described above, the vertical support panel structure 142 can be made of the same material as that of the external wall structure 140. However, for further economy of manufacture, the structure 142 is made of untreated, relatively inexpensive fiberboard, whereas the external wall structure 140 is made of fiberboard which has been treated to give it good wet-strength.

The "saddle bag" term refers to the fact that the vertical support panels 143 and 145 (FIG. 9) are not necessarily secured together back-to-back with adhesive, but instead are hinged at the top along a fold line 156 so that, if desired, the two receptacles of the carrier can be swung apart to give the user access to the advertising material and prizes, etc., which may be located on the inside surfaces of the panels 143 and 145.

Another advantage of the "saddle bag" structure is that, when filled with bottles or cans, it can be stacked on store shelves or in floor displays compactly so as to minimize the amount of space it occupies. This is accomplished by inserting the upstanding handle structure of one carrier into the gap between vertical support panels of the carrier above it. This also tends to stabilize stacks of the carriers forming floor displays.

Corresponding parts in the structures shown in FIGS. 1, 8 and 9 are given the same reference numerals, and will not be described in detail here.

The external wall structure blank 140 in FIG. 8 also folds along a central fold line 146. Four flanges 158, 160, 162 and 164 extend from the side edges of the panels 40, 42, 36 and 46, respectively.

When the blank 140 is being folded and glued, it is folded along the line 146, the flanges 158, 160, 162 and 164 are folded inwardly and glued. The flanges 158 and 160 are secured together, and the flanges 162 and 164 are secured together. When those flanges are secured together, they cover and are glued to the side edges 143 and 145 and 147 and 149 so as to firmly secure the vertical support panel structure to the external side wall structure.

The handle panels 148 and 150 then are folded downwardly and over holes 152 and 154 in the vertical support panels 143 and 145 and secured to the top edge of the two vertical support panels. They are attached to the upper edges of the side wall panels by means of weak perforations 87, 89. The bottom flanges are glued and folded to form bottom structures for two separate receptacles, each having two dividers and three compartments.

The carrier depicted in FIGS. 8 and 9 enjoys the same cost advantages of construction as those described above, but can be made to leave the two halves of the carrier free to swing apart from one another for the purposes described above. Of course, if preferred, the vertical support panels can be secured to one another back-to-back, thus making the carrier even stronger.

Manufacturing Method

The method of manufacturing the carrier represented by the blanks 140, 142 is depicted in FIG. 5. The difference between the method of manufacturing the carrier of FIGS. 1-4, 6 and 7 and that of FIGS. 8-9 is that the carrier of FIGS. 1-4, 6 and 7 uses linear folding and gluing equipment, and that of FIGS. 8-9 uses right-angle folding and gluing equipment.

One very significant feature of the invention is that the carriers of the invention can be made using equipment made by several different manufacturers and which is presently in use for manufacturing prior carriers. Therefore, little or no modification of existing equipment is required in adapting the equipment to making the carriers of the invention.

Hand-Loaded Carriers

As it was noted above, carriers of substantially the same construction as those described above can be used in fast-food outlets, sports arenas and stadiums, coffee shops, conventions, etc., to be used by customers to carry food or other objects away with them. Such carriers, unlike the six-pack carriers described above, usually are loaded by a sales clerk or other person by hand. The six-pack carriers usually are loaded by machines.

The hand-loadable carriers made in accordance with this invention have the same combination of external side wall structure and central vertical support panel structure made of different materials.

Such carriers tend to be taller than the six-pack carriers to carry some very tall beverage containers, and some use an optional tray with a slotted bottom which can be used by slipping it onto the vertical support structure. Such a tray usually is used to carry solid, dry food. Thus, it can be made of untreated fiberboard to save cost.

A detailed description of such carrier is not necessary to an understanding of this embodiment but is incorporated herein by reference, from my above-described pending patent applications.

Materials

The treated material used to form the exterior side wall structure of the carrier can be one of a variety of available materials but preferably is 0.20 gauge SUS board. This material is believed to be made of virgin wood fiber coated with polyethylene before forming the board to give it greater wet strength; that is, to give it greater strength when wet than it would have without the treatment.

Alternative materials which can be used instead are those made with recycled fibers treated in the same way, or treated using other methods to give the material good wet-strength.

The untreated fiberboard material can be any of a number of known materials, such as chip-board, Kraftpack, clay-coated news board, etc. The thickness of this material, when used for the vertical support panel, can be 0.16 to 0.20 gauge.

Of course, the thickness of the materials will depend, in part, upon the load to be carried in the carriers.

The above description of the invention is intended to be illustrative and not limiting. Various changes or modifications in the embodiments described may occur to those skilled in the art. These can be made without departing from the spirit or scope of the invention.

What is claimed is:

1. A foldable carrier, said carrier comprising (a) a first component comprising an external side wall structure, said external side wall structure comprising (1) a pair of long side panels, each having first and second ends;

(2) a first pair of shorter side panels, equal to one another in length, interconnecting one end of each of said long side panels together along fold lines; and (3) a second pair of shorter panels, each being of the same length as said first shorter panels and being connected to one of said ends of said long side panels opposite the end connected to one of said first pair of shorter side panels, (4) each of said side panels having a lower edge and a bottom-forming flange connected to said lower edge along a fold line, and (b) a second component separate from said first component and comprising an internal support structure, said internal structure comprising:

(1) a pair of central support panels, each having a top edge, a bottom edge and two side edges; and (2) each of said central support panels having a bottom-forming flange connected to said bottom edge along a fold line;

(c) said internal support structure being secured to said external side wall structure, and in which each of said flanges extending from said lower edges of said shorter side wall panels is foldable diagonally and is secured to an adjacent one of said flanges extending downwardly from one of said long side wall panels and one of said central support panels.

2. A carrier as in claim 1 in which said first component and said second component are made of materials selected from the group consisting of materials having the same wet-strength characteristics and materials having different wet-strength characteristics.

3. A carrier as in claim 2 including a handle structure secured to said top edges of said central support panels, and including a pair of side flanges, each extending from the outermost side edge of one of said second pair of shorter panels, said side flanges being secured together and to said handle structure, and to said central support panels.

4. A foldable carrier, said carrier comprising (a) an external side wall structure, said side wall structure comprising (1) two external side wall panel constructions, each comprising a long side wall panel with two opposed ends and a pair of shorter side wall panels each having a first side edge attached to one of said opposed ends along a fold line, (2) each of said shorter panels having a second side edge opposite said first side edge, (b) an internal wall structure, separate from said external wall structure, said internal structure comprising (1) a pair of central support panels, each having a top edge, a bottom edge and two side edges, (2) each of said central support panels being approximately the same length as one of said long side panels of said external side wall structure, (c) said second side edge of each of said shorter panels in each of said external sidewall panel constructions being secured to one side edge of one of said central support panels, to form two separate receptacles, and (d) a flange extending from the bottom edge of each of said external side wall panels and from each of said central support panels, said flanges being secured together to form a separate automatic-opening bottom structure for each of said two receptacles.

5. A carrier as in claim 4 including a handle structure comprising a pair of handle panels formed with one of said external side wall constructions, said handle panels being joined along a fold line, said central support panels being joined together along a fold line along said top edge, each of said central support panel structures and said handle panels having a handle hole, each of said central support panel structures being secured to one of said handle panels with said handle holes aligned, said central support panels being joined together.

6. A pair of blanks for forming a carrier, said blanks comprising (a) a first blank forming a vertical support panel structure comprising two panels made of a first material, (b) a second blank for forming external side wall panel structure made of a second material, (c) said external side wall structure being adapted to be secured to said vertical support structure and having a plurality of panels adapted to be secured together to form two separate folding receptacles extending from opposite sides of said vertical support panel structure when said carrier is assembled and unfolded, (d) each of said vertical support panels and each of said panels of said external side wall structure having a lower edge and a flange extending from said lower edge, selected ones of said flanges being adapted to be secured to an adjacent one of said flanges and diagonally foldable to form two separate automatically-unfolding bottom structures, one for each of said two receptacles, (e) said second material being selected from the group consisting of (a) a material of the same strength as said first material, and (b) a material of a strength different from that of said first material.

7. A pair of blanks as in claim 6 said vertical support panels each having an upper edge and a lower edge and two side edges, and being secured to the other of said vertical support panels along a fold line forming said upper edges.

8. A pair of blanks as in claim 6 in which each of said vertical support panels has at least one fold-out portion positioned to extend into one of said receptacles and to be secured to one of said external side wall panels to form a divider for said receptacle.

9. A pair of blanks as in claim 6 in which one of said flanges for each of said receptacles is adapted to engage with structure within said receptacle so as to hold said receptacle open when said carrier is unfolded.

10. A pair of blanks as in claim 6 in which said second blank comprises two groups of side wall panels joined along fold lines, said side wall panels forming a pattern selected from the group consisting of (1) joined end-to-end, with said flanges in a linear array along one edge of said blank, and (2) parallel to one another with said flanges extending in two parallel arrays on opposite edges of said blank.

* * * * *